US005894998A

United States Patent [19]

Schall et al.

[11] Patent Number: 5,894,998

[45] Date of Patent: Apr. 20, 1999

[54] AGITATOR MILL

[75] Inventors: Gisbert Schall, Park Ridge; Edward Casama, Fair Lawn, both of N.J.

[73] Assignee: Draiswerke, Inc., Mahwah, N.J.

[21] Appl. No.: 08/933,378

[22] Filed: Sep. 19, 1997

[30] Foreign Application Priority Data

Sep. 19, 1996 [DE] Germany ..... 196 38 354

[51] Int. Cl.[6] ..... B02C 17/00; B02C 17/16

[52] U.S. Cl. ..... 241/79; 241/171; 241/172; 241/179

[58] Field of Search ..... 241/171, 172, 241/79, DIG. 30, 173, 179, 79.2

[56] References Cited

U.S. PATENT DOCUMENTS

| | | | |
|---|---|---|---|
| 3,844,490 | 10/1974 | Schold et al. | 241/74 |
| 4,620,673 | 11/1986 | Canepa et al. | 241/69 |
| 5,062,577 | 11/1991 | Schmitt et al. | 241/171 |
| 5,133,508 | 7/1992 | Stehr et al. | 241/171 |
| 5,292,076 | 3/1994 | Oliver Pujol | 241/69 |
| 5,518,191 | 5/1996 | Bartsch et al. | 241/46.11 |
| 5,566,896 | 10/1996 | Stehr et al. | 241/171 |

FOREIGN PATENT DOCUMENTS 4142213 6/1993 Germany .

*Primary Examiner*—John M. Husar

*Attorney, Agent, or Firm*—Antonelli, Terry, Stout & Kraus, LLP

[57] ABSTRACT

An agitator mill for flowable mill charge grinding, has a fixed, outer, cylindrical grinding container, to which is coaxially fitted in spaced manner a cylindrical inner stator. A rotary driven, cup-shaped rotor is positioned coaxially to the grinding container and engages in the grinding area formed between the grinding container and the inner stator, so that the grinding area is subdivided into an outer grinding area and an inner grinding area, the grinding areas being interconnected hydraulically by means of a connecting area. A discharge device located within the inner stator is connected in the flow direction to the inner grinding area. A rotary, cylindrical separating screen is positioned coaxially to the rotor between the end of the inner grinding area and the discharge device. In order to ensure a correct operation of the agitator mill with relatively low constructional costs, the separating screen is fitted to the rotor and sealed with respect to the inner stator by means of a seal, particularly a slip ring seal.

5 Claims, 2 Drawing Sheets

AGITATOR MILL

FIELD OF THE INVENTION

The invention relates to an agitator mill for milling or grinding flowable mill charges.

BACKGROUND OF THE INVENTION

Such an agitator mill, as shown in DE 41 42 213 A1, has an outer, cylindrical grinding container, which is fixed and connected to a coaxially spaced, cylindrical inner stator. The grinding container and inner stator are closed at their lower end by means of a circular base, so that between the outer grinding container and the inner stator is formed a circular grinding area. A cover is also mounted on the upper end of the grinding container.

A downwardly open cup-shaped rotor is mounted in rotary manner coaxially to the grinding container and inner stator and comprises a rotor base positioned in the vicinity of the grinding container cover and a downwardly directed cylindrical part connected thereto. The cylindrical part extends into the grinding area formed between the grinding container and the inner stator. Thus, the grinding area is subdivided into a cylindrical outer grinding area and a cylindrical inner grinding area coaxial thereto, the two grinding areas being hydraulically connected by means of a lower connecting area at the lower end of the cylindrical part of the rotor.

Into the inner stator is integrated a discharge device, which has a discharge tube issuing into the upper region of the inner stator. The upper mouth or opening of the discharge tube is surrounded by a cylindrical filter or separating screen, which is closed at the top and has over its circumference a screening surface.

In order to sufficiently comminute the mill charge, on the grinding container, inner stator and cylindrical part of the rotor are provided agitating bolts. Moreover, the inner and outer grinding areas contain grinding beads, which are in particular balls made from glass, minerals, steel or the like.

The mill charge is fed into the outer grinding area, normally under a slight pressure, in the form of a slurry, i.e. as dry material with internal liquid, in the upper region of the grinding container cover, so that it mixes with the grinding beads. The mill charge and grinding beads flow downwards through the outer grinding area, flows below the rotor in the lower connecting area and then rises upwards in the inner grinding area, where it passes on to the separating screen at the upper end. The separating screen retains the grinding beads and coarse mill charge fractions and they flow back via radially directed overflow ducts into the outer grinding area, whereas the fine fractions pass through the separating screen into the discharge device.

In earlier agitator mills the separating screen was fitted to the inner stator and was consequently also fixed. It has been found that such a construction leads to several disadvantages. Firstly there can be a short-circuit flow through the overflow ducts between the outer and inner grinding areas, so that the mill charge does not flow first through the outer and inner grinding areas, so that the grinding capacity of the agitator mill is significantly reduced. It has also been found that in the case of a high throughput and high mill charge viscosity, the separating screen becomes relatively rapidly clogged, which also leads to an undesired pressure build-up in the agitator mill.

To prevent the clogging of the separating screen an attempt has been made to provide on the inside of the rotor stripping edges extending to the separating screen surface and passing over the same. However, it is not possible to in this way achieve the desired separating screen cleaning action. It has in fact been found that the mill charge is smeared by the stripping edges and the separating screen clogs even more rapidly, even if the grinding beads are transported outwards.

From the aforementioned DE 41 42 213 A1 it is known to fit the separating screen to the discharge device located in the inner stator and to mount the same rotatably therewith in the inner stator, a separate motor being required as the drive. The rotation of the separating screen leads to a self-cleaning due to centrifugal force and within the mill charge builds up an outwardly directed pressure, so that an inwardly directed short-circuit flow through the overflow ducts is reliably avoided. However, the constructional effort and expenditure for the rotary bearing of the discharge device in the inner stator and the arrangement of a separate drive motor is very high. It is also necessary to connect the rotary discharge tube, outside the grinding container, to a further extending, fixed line network, which also requires a complicated transition construction.

The problem of the invention is to provide an agitator mill of the aforementioned type, in which a correct operation can be ensured at relatively low constructional costs.

SUMMARY OF THE INVENTION

According to the invention this problem is solved in an agitator mill in that the separating screen is fitted to the rotor and is sealed with respect to the inner stator by means of a seal.

Thus, according to the invention, the separating screen rotates together with the rotor, so that there is no need to provide a separate drive motor. In addition, in the agitator mill according to the invention, the discharge device is fixed within the inner stator, so that there is no need for a transition construction rotating and fixed line sections. The connection of the rotating separating screen to the fixed inner stator takes place by means of a seal, preferably a slip ring seal.

Due to the rotation of the separating screen, in the agitator mill according to the invention, it is also possible to achieve the advantageous effects with respect to self-cleaning and the avoidance of a short-circuit flow, but the constructional costs are significantly reduced compared with the known structures.

According to an advantageous development of the invention, the upper end of the separating screen is fitted to the rotor base and is supported at its lower end by means of the slip ring seal on the inner stator. In this way the fine fractions of the mill charge can only pass out via the screen surface located on the circumference, because at the top the rotor base and at the bottom the slip ring seal form a tight termination.

Preferably the slip ring seal comprises two coaxial slip rings, which in known construction can be made from a material with a low friction coefficient. In order to ensure a reliable engagement of the two slip rings, they can be tensioned against one another by a spring tension. The spring tension can either be applied by an internal, axial tension of the separating screen or by an additional spring.

A uniform mill charge flow within the agitator mill and in particular a uniform passage of the mill charge fine fractions through the separating screen can be achieved if the upper end of the inner grinding area issues in known manner into an expansion area, which surrounds the separating screen. The expansion area is preferably connected by means of several radial overflow ducts with the outer grinding area through which the grinding beads and coarse mill charge fractions can flow back into the outer grinding area.

BRIEF DESCRIPTION OF THE DRAWINGS

Further details and features of the invention can be gathered from the following description of an embodiment with reference to the attached drawings, wherein show.

DETAILED DESCRIPTION RELATIVE TO THE DRAWINGS

Figure 1:
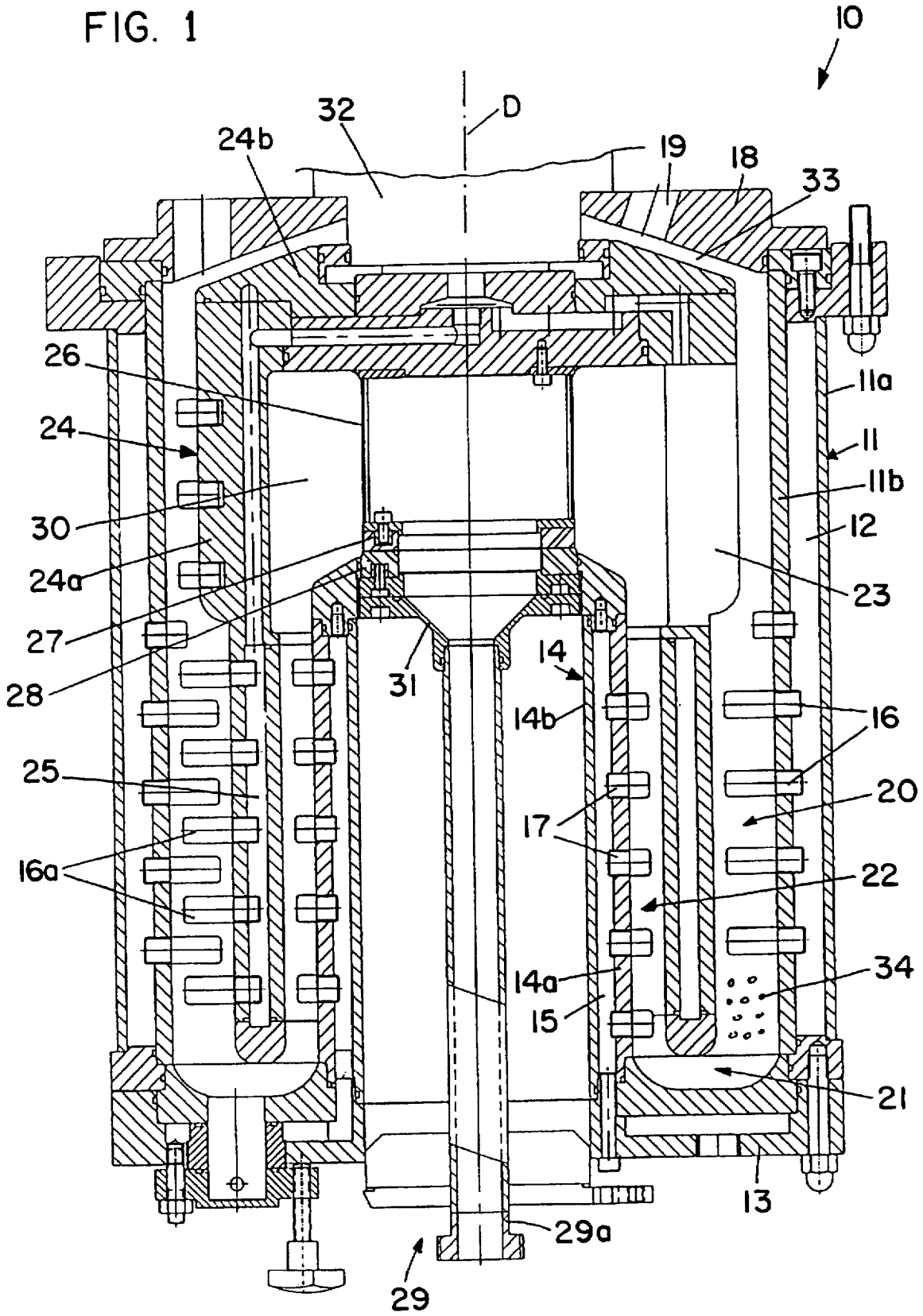
FIG. 1 A detail vertical section through an agitator mill.
Figure 2:
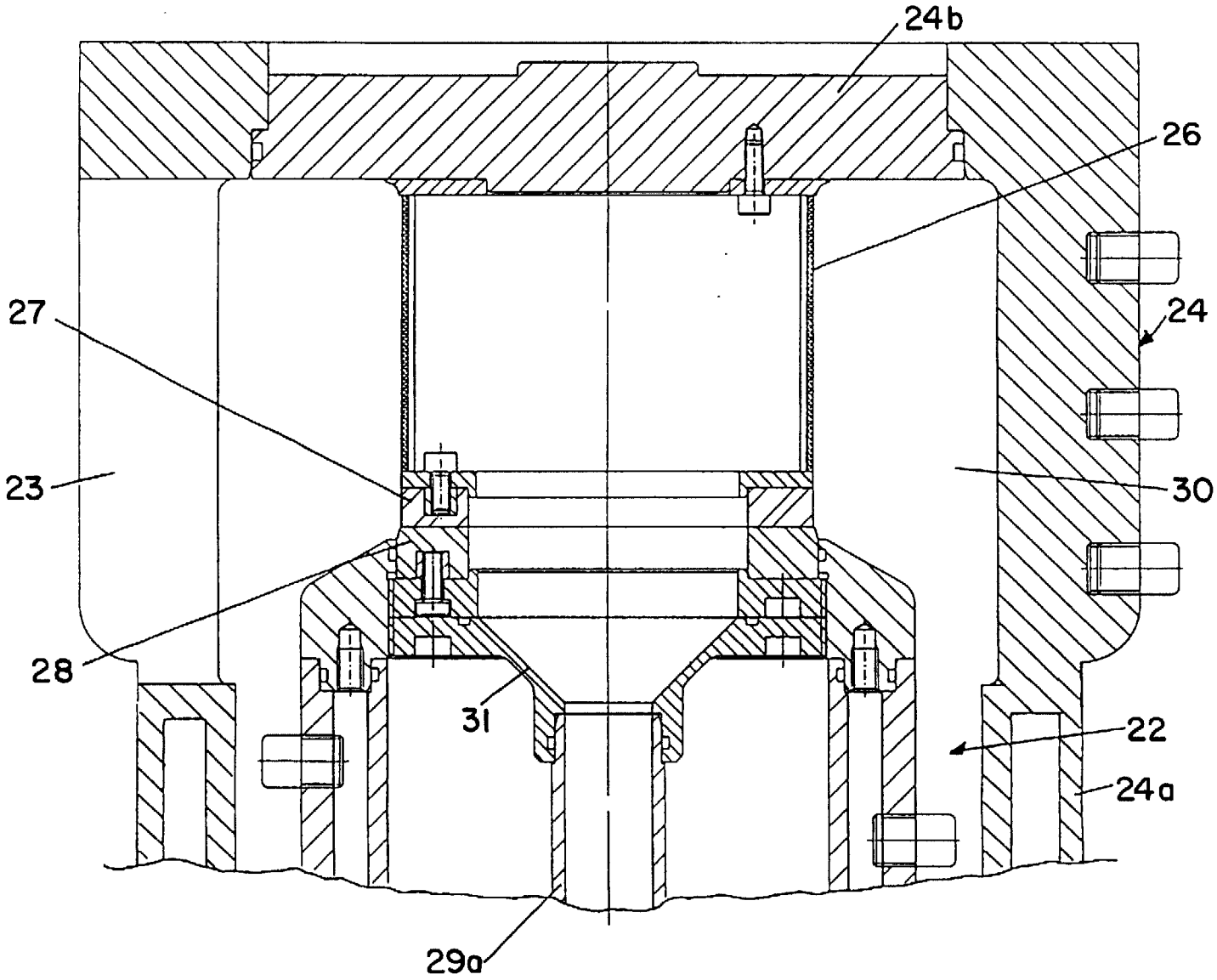
FIG. 2 The separating screen according to FIG. 1 in a larger scale detail.

The agitator mill 10 shown in FIGS. 1 and 2 has an outer cylindrical grinding container 11 constructed in double-walled manner and between the outer casing 11*a* and the inner casing 11*b* is formed an outer cooling area 12 through which flows in not shown manner a cooling fluid. At the upper end the outer grinding container 11 is substantially closed by a cover 18.

Coaxially to and spaced from the outer grinding container 11 is provided a cylindrical inner stator 14, which also has a double-walled structure and between the outer casing 14*a* and inner casing 14*b* is formed a cylindrical, inner cooling area 15, through which there is also a cooling fluid flow. Between the outer grinding container 11 and the inner stator 14 is formed an annular grinding area, which is closed on its underside by an annular base plate 13, which connects the outer grinding container 11 to the inner stator 14.

Within the inner stator 14 is provided a discharge device 29 with a discharge tube 29*a* extending coaxially to both the outer grinding container 11 and the inner stator 14 and which is fitted to the upper end of the inner stator 14, accompanied by the formation of a funnel-shaped extension or widening 31 on the inner stator 14. Thus, the outer grinding container 11, inner stator 14 and discharge device 29 form a fixed unit.

The cover 18 of the outer grinding container 11 is penetrated in fluid-tight manner by a drive shaft 32 to which a cup-shaped, downwardly open rotor 24 is connected within the agitator mill 10. The rotor 24 comprises a rotor base 24*b* arranged in the upper region and which carries a cylindrical part 24*a* connected to the bottom thereof. The rotation axis D of the rotor 24 coincides with the central axis of the outer grinding container 11 or inner stator 14. The cylindrical part 24*a* of the rotor 24 extends in the grinding area between the outer grinding container 11 and the inner stator 14, so that a cylindrical outer grinding area 20 and a cylindrical inner grinding area 22 are formed. At their lower end, the two grinding areas 20 and 22 are hydraulically connected by means of a connecting area 21. In the cover 18 of the outer grinding container 11 is provided a filling opening 19 for the mill charge and issues by means of a ring duct 33 into the outer grinding area 20.

On the inside of the outer grinding container 11 facing the grinding area, as well as the outside of the inner stator 14 facing the grinding area are in each case provided radially extending agitating bolts 16 and 17. Corresponding agitating bolts 16*a* are also fitted to the cylindrical part 24*a* of the rotor 24. The agitator bolts serve as agitating members and mainly bring about a thorough mixing of the mill charge. In the outer grinding area 20 and inner grinding area 22 are located spherical grinding members 34, which are diagrammatically indicated in FIG. 1.

The cylindrical part 24*a* of the rotor 24 also has a double-walled construction, so that a rotor cooling area 25 is formed and through it flows the cooling fluid.

On the underside of the rotary base 24*b* is tightly fitted coaxially to the rotation axis D a cylindrical separating screen 26 and which is fixed at its opposite side to a slip ring 27. The slip ring 27 is in contact with a corresponding, coaxially located slip ring 28, which is fitted to the upper end of the inner stator 14. As a result of a certain elastic inherent tension of the separating screen 26, the slip rings 27 and 28 are kept in contact.

At the upper end of the inner grinding area 22 is formed an expansion area 30 surrounding the separating screen 26 and from which several overflow ducts 23 pass radially outwards to the outer grinding area 20, only one of said ducts 23 being visible in the drawings.

The function of the agitator mill will now be described. The flowable mill charge is supplied under slight pressure through the filling opening 19 and then passes through the ring duct 33 into the outer grinding area 20, where the mill charge flows downwards, flows below the cylindrical part 24*a* of the rotor 24 at the lower connecting area 21 and then rises upwards in the inner grinding area 22. During said flow, the mill charge is subject to an intense grinding and dispersing process under the action of the agitator bolts 16*a* rotating with the rotor 24 and the fixed agitator bolts 16, 17 of the grinding container 11 or inner stator 14. The mill charge then passes into the expansion area 30 and the grinding beads 34 and coarse mill charge fractions, which cannot pass through the separating screen 26 due to the pressure gradient forming as a result of the rotation of the separating screen 26, are supplied outwards to the outer grinding area 20 through the overflow ducts 23. The mill charge fines can pass radially inwards through the separating screen 26, so that they pass downwards into the discharge tube 29*a* of the discharge device 29 and through the latter leave the agitator mill. For assisting the feeding of the fines to the discharge tube 29*a* can optionally be connected a suction pump.

We claim:

1. Agitator mill for flowable mill charge grinding, having a fixed, outer, cylindrical grinding container, to which is coaxially fitted in spaced manner a cylindrical inner stator, with a rotary driven, cup-shaped rotor positioned coaxially to the grinding container and which engages in the grinding area formed between the grinding container and the inner stator and subdivides the same into an outer grinding area and an inner grinding area, the grinding areas being hydraulically connected by means of a connecting area, and with a discharge device located within the inner stator and connected in the flow direction to the inner grinding area, and between the end of the inner grinding area and the discharge device, coaxially to the rotor, is located a rotary, cylindrical separating screen, characterized in that the separating screen is fitted to the rotor and is sealed with respect to the inner stator by means of a seal, and further characterized in that the upper end of the separating screen is fitted to the rotor base and its lower end is supported by means of a slip ring seal to the inner stator.

2. Agitator mill according to claim 1, characterized in that the slip ring seal comprises two coaxial slip rings engaging on one another under spring tension.

3. Agitator mill according to claim 1 and 2, characterized in that the inner grinding area issues into an expansion area, which surrounds the separating screen.

4. Agitator mill according to claim 3, characterized in that the expansion area is connected by means of radial overflow ducts to the outer grinding area.

5. Agitator mill according to claim 1, wherein the discharge device is fixed within the inner stator.

* * * * *